US005702534A

United States Patent [19]

Rodabaugh et al.

[11] Patent Number: 5,702,534

[45] Date of Patent: Dec. 30, 1997

[54] HYDROGEN PEROXIDE PICKLING OF STAINLESS STEEL

[75] Inventors: Ronald D. Rodabaugh, Lebanon; Jerald W. Leeker, Trenton, both of Ohio

[73] Assignee: Armco Inc., Middletown, Ohio

[21] Appl. No.: 667,498

[22] Filed: May 24, 1996

[51] Int. Cl.[6] ..... B08B 1/02; B08B 3/08; C23G 1/02

[52] U.S. Cl. ..... 134/7; 134/10; 134/15; 134/28; 134/41

[58] Field of Search ..... 134/2, 3, 7, 9, 134/10, 15, 26, 27, 28, 41

[56] References Cited

U.S. PATENT DOCUMENTS

| | | | |
|---|---|---|---|
| 3,457,107 | 7/1969 | Michelson et al. | 134/3 |
| 3,460,989 | 8/1969 | Rusch | 134/3 |
| 3,489,625 | 1/1970 | Dell et al. | 134/28 |
| 3,715,236 | 2/1973 | Fukui et al. | 134/2 |
| 3,806,366 | 4/1974 | Cofer et al. | 134/15 X |
| 5,131,126 | 7/1992 | Katsuki et al. | 134/15 X |
| 5,154,774 | 10/1992 | Bousquet et al. | 134/3 |
| 5,292,374 | 3/1994 | Maresch et al. | 134/15 X |

FOREIGN PATENT DOCUMENTS

| | | | |
|---|---|---|---|
| 64022 | 5/1979 | Japan . | |
| 243289 | 12/1985 | Japan . | |
| 20494 | 1/1988 | Japan . | |
| 003318 | 7/1989 | Japan | 134/15 |

*Primary Examiner*—Robert J. Warden
*Assistant Examiner*—Saeed Chaudhry
*Attorney, Agent, or Firm*—R. J. Bunyard; L. A. Fillnow

[57] ABSTRACT

A process for removing scale from stainless steel using an aqueous solution containing hydrogen peroxide. A hot rolled or annealed stainless steel strip (10) covered with scale is immersed into hot sulfuric acid contained within tanks (12) and (14). Thereafter, the strip may have residual amounts of tightly adherent scale (11). This scale is activated by the aqueous solution containing hydrogen peroxide applied to the strip such as by a spray header (16) extending completely transversely across and positioned above the strip and another spray header (18) extending completely transversely across and positioned below the strip. Any peroxide spray dripping from the, strip is collected on a catch pan (30) and flowed into a tank (28). Preferably, the peroxide solution is a dilute concentration of the acid in tanks (12) and (14). The hydrochloric acid removes smut from the strip formed by the sulfuric acid to improve the cleanliness of the pickled strip.

20 Claims, 2 Drawing Sheets

HYDROGEN PEROXIDE PICKLING OF STAINLESS STEEL

BACKGROUND OF THE INVENTION

This invention relates to a process for descaling ferrous alloys containing chromium using acid. More specifically, oxide on a hot rolled or annealed ferrous alloys containing chromium is removed by sequentially immersing the alloy in an acid and then applying an aqueous solution containing hydrogen peroxide to the pickled alloy.

One of the most environmentally intensive problems in the steel making industry is pickling of steel to remove oxide or scale formed during hot processing such as rolling on a hot strip mill or annealing. Most low carbon steels may be descaled in hydrochloric acid at high speeds. The scale on stainless steel, however, has a very fine structure, generally has a greater thickness and is tightly adherent usually requiring mechanical scale cracking such as shot blasting, roll bending or leveling to the steel strip to loosen the scale prior to acid pickling. Additionally, stainless steel pickling acids such as hydrofluoric, sulfuric, nitric or mixtures thereof generally must be more aggressive than those required for low carbon steel. The immersion time required for stainless steel is much longer than that required for low carbon steel and may require electrical assistance to help remove the scale as well. A major motivation for improving the scale removing process is the capital and environmental disposal costs associated with pickling acids. A major disadvantage of chemical descaling using hydrofluoric and nitric acids is the environmental problems related to their disposal.

It also is known to use acid mixtures containing hydrogen peroxide for pickling and cleaning stainless steel. For example, U.S. Pat. 5, 154,774 teaches adding an oxygenated agent, e.g., hydrogen peroxide, potassium permanganate or air, to a hydrofluoric acid for pickling stainless steel to convert ferrous ions to ferric ions. Japanese patent application 63-20494discloses a method for chemically removing scale from the surface of stainless steel by adding an adhesive to a mixed solution containing hydrogen peroxide, phosphoric acid and hydrogen fluoride. A material which is not decomposed by hydrogen peroxide and gives viscosity to the cleaning solution, e.g., a compound of an alkaline earth metal, colloidal silica powder or activated clay powder, is suitable for use as the adhesive for forming a pasty liquid. Japanese patent application 60-243289 discloses reducing the amount of smut on steel and reducing hydrogen absorbed by the steel using an acid bath containing hydrofluoric acid, hydrogen peroxide and hydrochloric acid or sulfuric acid. Japanese patent application 54-64022 discloses providing a viscous pickling agent for removing stain and scale from stainless steel. Abrasive particles such as fused alumina powder, Cr oxide particle, Si carbide powder, $SiO_2$ powder are added to an acidic solution containing hydrogen peroxide, sulfuric acid, hydrochloric acid and a surfactant agent. Japanese patent application 58-110682 discloses pickling hot rolled stainless steel with a solution containing sulphamic acid, nitric acid, hydrofluoric acid and hydrogen peroxide.

Although these acids are effective for removing scale from stainless steel, their use creates certain undesirable problems and have their limitations. For example, using sulfuric acid for removing scale from stainless steel is undesirable because this acid leaves a black smut on the pickled steel. Hydrochloric acid pickling results in a bright stainless steel surface but it too is undesirable because it reacts too slowly with the tightly adhering scale. More aggressive acids such as nitric and hydrofluoric to remove the scale from stainless steel are especially undesirable because their use creates environmental problems requiring fume abatement equipment to handle fumes from the pickling tanks, special equipment for storing the acids, and the pickling by-products require special handling and costly disposal. Other disadvantages include the safety and health risks associated from chronic exposure to these acids and limits on allowable nitrate and fluoride discharge in effluents from treated wastes.

Accordingly, there remains a need for a process for pickling ferrous alloys containing chromium that does not include nitric and hydrofluoric acids or fluoride compounds. There remains a further need for a process for pickling ferritic alloys containing chromium that does not create costly environmental disposal problems of the pickling waste by-products. Another need includes being able to obviate the need for expensive pollution control and waste treatment facilities associated with using nitric and hydrofluoric acids or fluoride compounds.

BRIEF SUMMARY OF THE INVENTION

A principal object of the invention is to provide a ferrous alloy containing chromium having a bright, oxide free surface, without using pickling solutions whose by-products cause an environmental disposal problem.

Another object of the invention is to provide a ferrous alloy containing chromium having a bright, oxide free surface without using nitric or hydrofluoric acids.

Another object of the invention includes providing a pickling scheme wherein the chemical cost is no greater than that otherwise required for nitric and hydrofluoric acids.

Another object of the invention is to pickle a ferrous alloy containing chromium at a speed of at least 30 m/min.

The invention relates to a hot rolled or annealed ferrous alloy containing chromium being descaled with an acid. The steel is pretreated to crack the scale and then immersed into a first tank containing a pickling acid to remove the cracked scale. Thereafter, an aqueous solution containing hydrogen peroxide is applied to the pickled alloy wherein any remaining scale becomes activated by the peroxide. Thereafter, the alloy is immersed into a second tank containing an acid to remove any residual scale.

Another feature of the invention is for the aforesaid peroxide solution to contain at least about 10 g/l peroxide.

Another feature of the invention is for the aforesaid peroxide solution to contain at least about 20 g/l acid.

Another feature of the invention is for the aforesaid peroxide solution to contain the same acid as that of the first tank.

Another feature of the invention is for the aforesaid peroxide solution being recycled to the first tank.

Another feature of the invention is for the aforesaid acid being from the group consisting of sulfuric and hydrochloric.

Another feature of the invention is for the aforesaid first tank containing at least about 150 g/l sulfuric acid.

Another feature of the invention is for the aforesaid the second tank containing at least about 50 g/l hydrochloric acid.

Advantages of the invention include using an aqueous solution containing hydrogen peroxide for removing hot roll mill scale from a ferrous alloy strip containing chromium rather than using nitric or hydrofluoric acids, increased pickling speeds, fewer environmental concerns, disposal of a solution containing hydrogen peroxide being compatible with the by-products of when using hydrochloric acid and sulfuric acid and a smut free chromium alloyed strip. Other advantages include electrical assistance for removing scale is not required and a more passive corrosion resistant pickled strip surface is formed.

The above and other objects, features and advantages of the invention will become apparent upon consideration of the detailed description and appended drawings.

DETAILED DESCRIPTION OF THE PREFERRED EMBODIMENT

Figure 1:
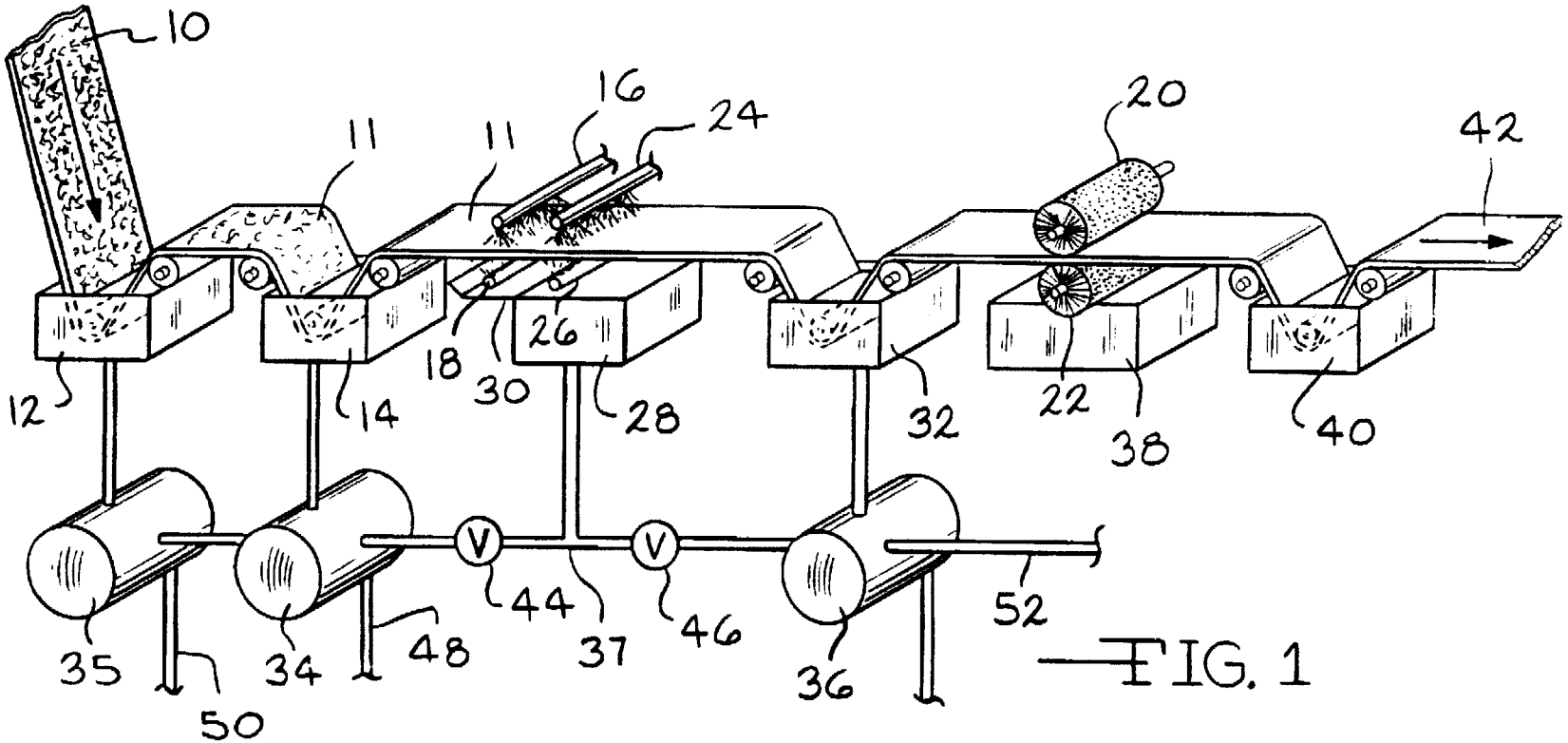
FIG. 1 schematically illustrates a pickling line incorporating the process of the invention, and FIG. 2 schematically illustrates another embodiment of means for applying a peroxide solution to a pickled ferrous alloy strip.

This invention relates to a process for descaling a ferrous alloy containing chromium, such as ferritic stainless steel, using acid. More specifically, oxide or scale, hereafter referred to as scale, on a hot rolled or an annealed ferrous alloy containing chromium is removed by immersing the alloy into hydrochloric (HCl) and/or sulfuric acid ($H_2SO_4$), applying an aqueous solution containing hydrogen peroxide ($H_2O_2$) to the pickled alloy to activate any residual scale remaining on the alloy and pickling the alloy again with the hydrochloric and/or sulfuric acid. By activating any residual scale with a solution containing hydrogen peroxide, it has been determined the use of nitric or hydrofluoric acids and/or fluoride containing compounds is no longer required to adequately remove scale from ferrous alloys containing chromium.

By a ferrous alloy containing chromium is meant an alloy of iron and chromium, e.g., chromium alloy steel, stainless steel, in which the chromium content is at least about 5% Cr, preferably at least 10% Cr and up to about 30 Cr%. The alloy preferably is a ferritic stainless steel including up to about 0.5% Al, up to about 0.3% of C, up to about 1% of each of Si, Ti, Nb, Zr; up to about 5% of each of Ni and Mo and up to about 1½% Mn. All percentages are by wt.%. The alloy may include purposeful additions of one or more of Ta, Ca, Cu, B and N as well.

After a scale is formed during hot processing rolling on a hot strip mill or in a continuous annealing furnace, a stainless steel strip, sheet or foil, referred to hereafter as strip, is given a mechanical scale cracking treatment such as shot blasting or roll bending to loosen the scale. Thereafter, the strip is immersed into a first acid, e.g., sulfuric or hydrochloric, to remove most of the cracked scale. An important feature of the invention is to apply an aqueous solution containing hydrogen peroxide onto the pickled strip wherein any remaining scale becomes activated by the hydrogen peroxide. Preferably, the peroxide solution contains the same acid as that in the first tank. By activated is meant the hydrogen peroxide reacts with the base metal of the steel to loosen and/or decompose the scale tightly adhering thereto thereby removing it from the steel substrate. This remaining scale then becomes removed when being immersed into a second acid for rinsing. If the initial acid is sulfuric, then the second acid should be hydrochloric to remove any black smut formed on the strip by the sulfuric acid. After the second acid rinse, the strip preferably is brushed to loosen and adequately remove any minor amount of residual scale not dissolved during the second acid rinse.

Preferably, the peroxide solution contains a dilute concentration of the same acid as that in the first tank. If so, the applied peroxide solution can be recycled to a tank holding the first acid. Considerable make up solution is required in the tank containing the first acid because of evaporation when the acid is hot. The peroxide solution can advantageously be disposed of by being recycled into the tank containing the first acid.

Hydrogen peroxide tends to breakdown into its basic components, i.e., water and oxygen, very rapidly when iron becomes removed from steel strip and dissolved into a solution containing the peroxide. For this reason, the peroxide of the invention preferably is dissolved into an aqueous solution with the peroxide solution being applied directly to the surface of the strip rather than being contained within an immersion tank. If the peroxide were dissolved within an acid solution stored within an immersion tank, the peroxide containing solution would break down and become dysfunctional after a short period of time no longer activating any residual scale remaining on the pickled strip.

It was surprisingly discovered the residual scale advantageously need only remain in contact with the peroxide solution a very short period of time to become sufficiently activated thereby easily being removed by the second acid. Residual scale can be removed from the strip using an activation time as short as about 3 seconds. Preferably, the activation time will be at least 5 seconds.

Referring to FIG. 1, reference numeral 10 schematically illustrates a ferrous alloy strip containing chromium such as stainless steel covered with a scale such as from rolling on a hot strip mill. The scale on strip 10 would have been cracked such as being passed through a shot blasting machine or roller leveler (not shown). The scale of a stainless steel should be cracked whenever nitric and/or hydrofluoric acid is not used. Thereafter, the strip is immersed into a first acid such as sulfuric or hydrochloric contained within tanks 12 and 14. Thereafter, the strip normally may have residual amounts of tightly adherent scale 11. This scale is activated by being contacted with an aqueous solution containing hydrogen peroxide. This peroxide solution may be sprayed onto the strip such as by a spray header 16 extending completely transversely across and positioned above the strip and another spray header 18 extending completely transversely across and positioned below the strip. Preferably, another pair of spray headers 24 and 26 extending transversely completely across the strip is provided. Using multiple spray headers above and below the strip increases the activation time of the residual scale by the hydrogen peroxide. Any peroxide spray dripping from the strip may be collected onto a catch pan 30 and flowed into a tank 28. The strip then is immersed into a second acid contained in a tank 32. The acid in tank 32 can be hydrochloric or sulfuric. If the acid in tanks 12 and 14 is sulfuric, then the acid in tank 32 preferably is hydrochloric to remove smut from the strip formed by the sulfuric acid to improve the cleanliness of a cleaned strip 42. After the second acid, it is desirable to abrade the pickled steel strip by one or more pairs of brushes 20 and 22. The brushes are of a grit impregnated polymer construction.

The peroxide solution preferably includes an acid of the same type as that contained within tanks 12 and 14. If so, the collected sprayed solution can be recycled back to either of tanks 12 and 14 as makeup for liquid lost to evaporation. The recycled peroxide solution can flow by gravity to tanks 34 and 35 or 36 through a line 37 by opening either of valves 44 or 46 respectively. If the acid in the peroxide solution is compatible with the acid in first tanks 12 and 14, the peroxide solution may be recycled to tanks 12 and 14. If the acid in the peroxide solution is compatible with the acid in second acid tank 32, the peroxide solution may be recycled to tank 32. After the acids become saturated with iron, the acid is replaced with fresh acid. Spent acid may be periodically withdrawn form tanks 12 and 14 through a line 50 and sent to an acid recovery plant (not shown). Fresh acid would be returned to tanks 12 and 14 through a return line 48. The fresh acid, along with the recycled peroxide solution containing a dilute solution of the same acid, would be pumped into tank 14. Spent acid may be periodically withdrawn form tank 32 through a line 52 and sent to an acid recovery plant as well.

Figure 2:
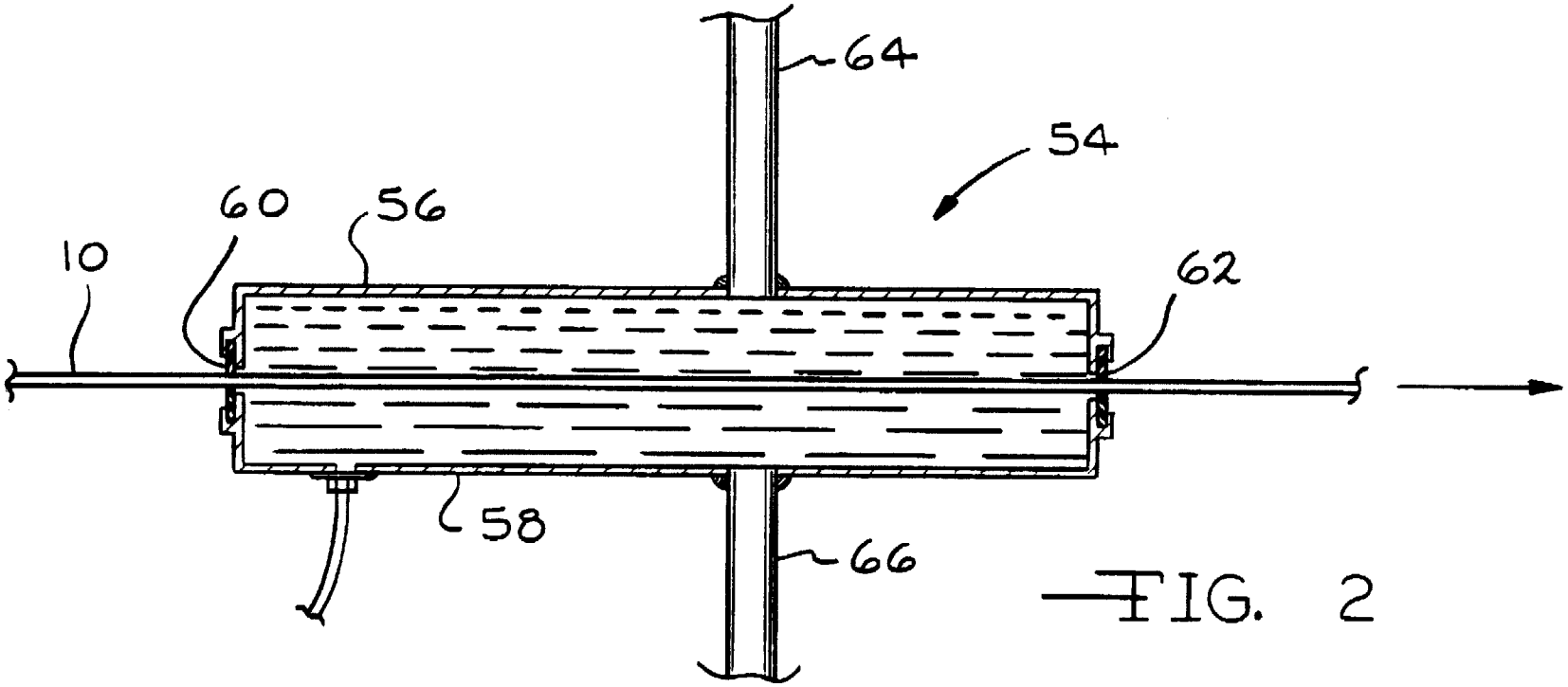

Other means for applying the peroxide solution to the pickled steel may include using laminar flow or an absorbent contact roller for contacting each side of a steel strip. FIG. 2 illustrates another embodiment for applying the peroxide solution to the pickled steel using laminar flow. The pickled strip is passed through a laminar flow means 54. Laminar flow means 54 includes a pair of juxtaposed panels 56 and 58 sealably joined on a strip entry end 60 and a strip exit end 62. Ends 60 and 62 include squeegee type wipers for sealing the ends of the applicator. The peroxide solution is pumped into laminar flow means 54 through a line 64. The steel strip would be immersed into the peroxide containing solution. Spent solution would be periodically withdrawn from laminar flow means 54 through a line 66 for recycling to one of the acid tanks.

The strip preferably is initially pickled in hot sulfuric acid maintained at a temperature of at least 88° C., more preferably at least 93° C. and most preferably heated to at least 99° C. Preferably, the concentration of the acid is maintained at 150 g/l, more preferably at least 200 g/l and most preferably at least 250–350 g/l. Hydrochloric acid in tank 32 is heated to a temperature of at least 77° C., more preferably at least 82° C. and most preferably heated to at least 88° C. Preferably, the concentration of the hydrochloric acid is maintained at 50 g/l, more preferably at least 75 g/l and most preferably at least 100–200 g/l. The primary function of the hydrochloric acid is to remove the smut on the strip caused by sulfuric acid.

To be effective, the concentration of the hydrogen peroxide in the aqueous solution should be at least 10 g/l. If it is not at least 10 g/l, the peroxide will not effectively remove scale from the stainless steel strip. Preferably, the hydrogen peroxide will be at least 20 g/l, more preferably, at least 30 g/l and most preferably at least 40 g/l. Although the peroxide can be dissolved in water for applying to the strip, residual scale removal will be more effective if hydrochloric or sulfuric acid is dissolved in the aqueous solution. Preferably, the solution will contain at least 5 g/l acid, more preferably, at least 10 g/l acid and most preferably at least 20 g/l acid.

EXAMPLE 1

In an example, a 409 grade stainless steel was hot rolled on a continuous strip mill and then shot blasted. Thereafter, the steel strip was cut into coupons which were pickled in a solution containing 280 g/l sulfuric acid at 99° C. and then pickled in 150 g/l hydrochloric acid at 88° C. The coupons then were removed from the acid, rinsed with water, brushed and dried. The coupons contained small amounts of scale and a large amount of smut. The dirty appearance of the coupons would result in the steel being unacceptable for many exposed applications.

EXAMPLE 2

In another example, the hot rolled stainless steel of Example 1 was processed in accordance with the invention. The samples were processed in a manner similar to that described in Example 1 except as noted herein. After being pickled in the hot sulfuric acid, the coupons were immersed for 5 seconds into an aqueous solution at 88° C. containing 20 g/l of sulfuric acid and 40 g/l $H_2O_2$. The coupons were removed from the aqueous solution, rinsed with water, brushed and then pickled again in hydrochloric acid at 88° C. The coupons then were removed from the second acid, rinsed with water, brushed and dried. Unlike the coupons of Example 1, this time the coupons contained no scale and no smut. These samples processed according to the invention had a very bright appearance and resulted in a steel acceptable for all exposed applications. This demonstrated the importance of adding the hydrogen peroxide to the aqueous solution to obtain a clean surface free of smut and scale.

It will be understood various modifications may be made to the invention without departing from the spirit and scope of it. Therefore, the limits of the invention should be determined from the appended claims.

What is claimed is:

1. A process for removing scale from a ferrous alloy containing chromium, comprising:

providing a ferrous alloy strip containing chromium covered by scale, pretreating the strip to crack the scale, immersing the strip into a first tank containing a first pickling acid to remove the cracked scale thereby forming a pickled strip, applying an aqueous solution free of dissolved iron and containing hydrogen peroxide to the pickled strip wherein any remaining scale on the pickled strip becomes activated by the peroxide, immersing the activated strip into a second tank containing a second acid to remove any residual scale thereby forming a clean strip.

2. The process of claim 1 wherein the aqueous solution contains at least about 10 g/l peroxide.

3. The process of claim 1 wherein the aqueous solution contains at least about 5 g/l acid.

4. The process of claim 3 wherein the aqueous solution contains the first acid.

5. The process of claim 4 wherein the aqueous solution is recycled to the acid of one of the tanks.

6. The process of claim 5 wherein the aqueous solution is recycled to the first tank.

7. The process of claim 1 wherein the aqueous solution contains at least about 10 g/l acid and at least about 20 g/l peroxide.

8. The process of claim 1 wherein the acid in the tanks is from the group consisting of hydrochloric and sulfuric.

9. The process of claim 1 wherein the second acid is hydrochloric.

10. The process of claim 1 wherein the first tank and the aqueous solution both contain sulfuric acid and the second acid is hydrochloric.

11. The process of claim 1 wherein the strip is hot rolled or annealed ferritic stainless steel.

12. The process of claim 1 wherein the pretreatment is shot blasting.

13. The process of claim 1 wherein the pickled strip is brushed to loosen any residual scale not removed by the second acid.

14. The process of claim 1 wherein the first tank contains at least about 150 g/l sulfuric acid at a temperature of at least 88° C.

15. The process of claim 14 wherein the first tank contains at least 250–350 g/l sulfuric acid.

16. The process of claim 1 wherein the second tank contains at least about 50 g/l hydrochloric acid at a temperature of at least 77° C.

17. The process of claim 16 wherein the second tank contains 100–200 g/l hydrochloric acid and a temperature of at least 82° C.

18. The process of claim 1 wherein the first acid is contained in a plurality of tanks, the acid being counter current flowed through the tanks in a direction opposite the direction of travel of the strip.

19. A process for removing scale from steel, comprising:

providing a stainless steel strip covered by a scale, pretreating the strip to crack the scale, immersing the treated strip into a first tank containing sulfuric acid or hydrochloric acid to remove the cracked scale thereby forming a pickled strip, applying a solution free of dissolved iron and containing at least 5 g/l of the acid, and at least 10 g/l hydrogen peroxide to the pickled strip wherein any remaining scale on the pickled strip becomes activated by the peroxide, immersing the activated strip into a second tank containing hydrochloric acid to remove any residual scale, and recycling the aqueous solution to one of the tanks.

20. A process for removing scale from steel, comprising:

providing a ferritic stainless steel strip covered by a scale, pretreating the strip to crack the scale, immersing the treated strip into a first tank containing at least 150 g/l sulfuric acid to remove the cracked scale thereby forming a pickled strip, applying a solution free of dissolved iron and containing at least 10 g/l of the acid, and at least 20 g/l hydrogen peroxide to the pickled strip wherein any remaining scale on the pickled strip becomes activated by the peroxide, immersing the activated strip into a second tank containing at least 50 g/l hydrochloric acid to remove any residual scale, recycling the aqueous solution to the sulfuric acid, and brushing the pickled strip to loosen any residual scale not removed by the acid.

* * * * *